US007515045B2

(12) United States Patent
Paul et al.

(10) Patent No.: US 7,515,045 B2
(45) Date of Patent: Apr. 7, 2009

(54) WIRELESS MICRO-ELECTROMECHANICAL (MEMS) APPARATUS AND METHOD FOR REAL TIME CHARACTERIZATION OF MOTION PARAMETERS

(75) Inventors: Goutam Paul, Saratoga, CA (US); Madhav Rangaswami, Chandler, AZ (US); Devadas D. Pillai, Chandler, AZ (US); Bimal Dey, Chandler, AZ (US); Ralph M. Kling, Sunnyvale, CA (US)

(73) Assignee: Intel Corporation, Santa Clara, CA (US)

( * ) Notice: Subject to any disclaimer, the term of this patent is extended or adjusted under 35 U.S.C. 154(b) by 371 days.

(21) Appl. No.: 11/238,241

(22) Filed: Sep. 29, 2005

(65) Prior Publication Data

US 2007/0069892 A1 Mar. 29, 2007

(51) Int. Cl.
*G08B 1/08* (2006.01)

(52) U.S. Cl. ..... 340/539.17; 340/539.13; 340/686.1; 340/573.1; 340/573.4; 340/425.5; 73/488; 73/489; 73/491; 73/495

(58) Field of Classification Search ..... 340/539.17, 340/539.13, 686.1, 573.1, 573.4, 425.5; 73/488, 73/489, 491, 495

See application file for complete search history.

(56) References Cited

U.S. PATENT DOCUMENTS

| | | | | |
|---|---|---|---|---|
| 6,526,831 | B2 * | 3/2003 | Ben-Romdhane | 73/660 |
| 2005/0081629 | A1 * | 4/2005 | Hoshal | 73/504.03 |
| 2005/0093709 | A1 * | 5/2005 | Franco et al. | 340/686.1 |

* cited by examiner

*Primary Examiner*—Tai T Nguyen
(74) *Attorney, Agent, or Firm*—Blakely, Sokoloff, Taylor & Zafman LLP

(57) ABSTRACT

A sensor package comprising a micro-electromechanical (MEMS) motion sensor, an analog-to-digital converter coupled to the MEMS motion sensor, and a wireless transceiver coupled to the analog-to-digital converter, wherein the sensor package can wirelessly communicate with one or more wireless receivers and, if present, with one or more other sensor packages. A process comprising attaching one or more sensor packages to one or more vehicles or devices (mobile or stationary), each sensor package comprising a micro-electromechanical (MEMS) motion sensor, an analog-to-digital converter coupled to the MEMS motion sensor, and a wireless transceiver coupled to the MEMS motion sensor; sensing the motion of the one or more vehicles or devices to which each sensor package is attached; and transmitting motion data from the sensor package to a wireless receiver or to another sensor package.

5 Claims, 7 Drawing Sheets

WIRELESS MICRO-ELECTROMECHANICAL (MEMS) APPARATUS AND METHOD FOR REAL TIME CHARACTERIZATION OF MOTION PARAMETERS

TECHNICAL FIELD

The present invention relates generally to micro-electromechanical (MEMS) and other physical environment sensors operating in a wireless network and in particular, but not exclusively, to MEMS devices operating in a wireless network to characterize motion parameters of moving or stationary devices.

BACKGROUND

Many industries now depend heavily on automated manufacturing systems. A subset of an automated manufacturing system is an automated material handling system (AMHS) that moves work-in-process through various processing steps that take place in one or more bays in a manufacturing or warehousing facility. A typical handling system includes mobile components such as inter-bay vehicles that carry work-in-process between work stations within the same bay, intra-bay vehicles that carry work-in-process between different bays, and work-in-process storage systems called "stockers." The handling system can also include various stationary devices, such as robots, that perform some sort of operation on the work-in-process. For example, robots might load and unload work in process from a vehicle.

Obtaining maximum manufacturing throughput with an AMHS requires that the motion parameters (e.g., velocity, acceleration) of the various components of the system be carefully orchestrated and optimized. In existing systems, motion parameters are not monitored in real time or near real time to proactively identify potential problems. Usually, relevant motion parameters are set through an initial run or calibration, and then the system is allowed to run until something goes wrong. Only when something goes wrong do the operators know there is a problem. Things that can go wrong include lack of synchronization of moving vehicles resulting in increased traffic congestion leading to decreased throughput, vibration of vehicles, robots or other components resulting in damage to work-in process, and the like. Usually these problems are created by factors such as misalignment, normal wear-and-tear of the system, faulty component design, and human error.

Existing sensors for characterizing motion parameters are used retroactively to try to find the source of the problem once the AMHS has failed. These instruments have several fundamental shortcomings. They are expensive and also are large so that only one type of sensor can be mounted at a time. They are also so massive that they can alter the mass characteristics of the device whose motion they measure such that it's not clear what is being measured. They also have very limited capabilities. For example, they have no capability to transmit and display real-time data to a remote location. Instead, they rely on recording devices to record motion parameters for a fixed period of time; the collected motion data must then be downloaded from the recording devices and processed manually very periodically. Because they do not operate in real time, they cannot proactively predict or address equipment downtime issues. Moreover, they have no capability to network together multiple sensors, including sensors of different types.

Existing sensors for characterizing motion parameters also have several less-fundamental shortcomings. For example, they have limited data storage capacity; they do not time-stamp the actual data being monitored, making time-based analysis and cross-correlation impossible; they are customized for one type of sensor; they measure only composite values of motion parameters (vector addition of motion along the three axes), rather than values along multiple axes at the same time, and cannot measure velocities; they are manually intensive to set up and use; they cannot be integrated with factory control systems to provide downtime event synchronization; and they have no capability to identify potential safety and equipment failure events.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION OF THE ILLUSTRATED EMBODIMENTS

Embodiments of an apparatus, system and method for sensing, transmitting, analyzing and characterizing motion parameter of a system are described herein. In the following description, numerous specific details are described to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail but are nonetheless encompassed within the scope of the invention.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in this specification do not necessarily all refer to the same embodiment. Furthermore, the particular features, structures, or characteristics may be combined in any suitable manner in one or more embodiments.

Figure 1:
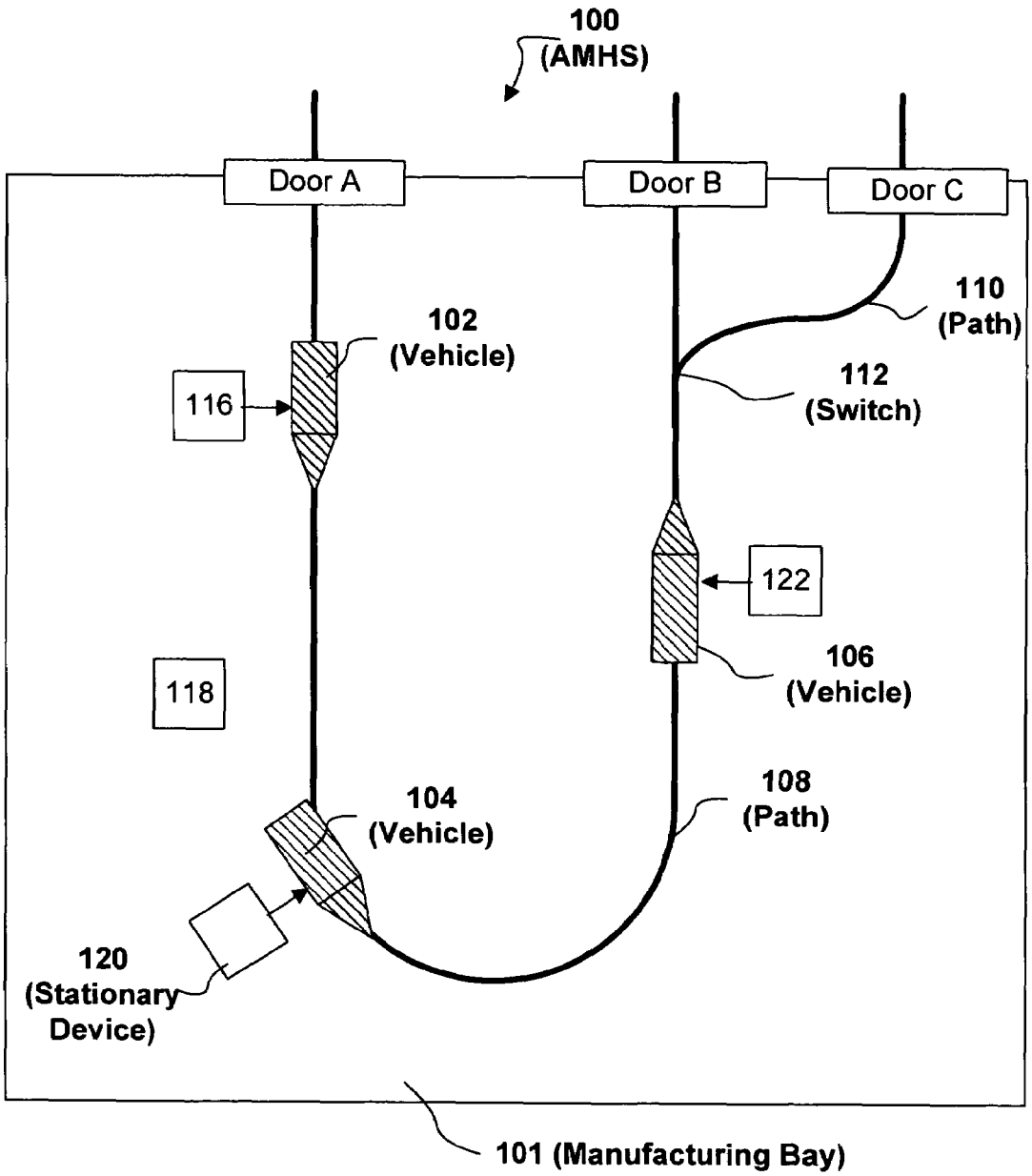
FIG. 1 is a plan-view schematic of an embodiment of the transport section of an automated material handling system (AMHS).

FIG. 1 illustrates an embodiment of an automated materials handling system (AMHS) 100 commonly used in manufacturing or warehousing applications such as microelectronics, automobiles, and the like. The system 100 is set up in a manufacturing bay 101 and includes several inter- or intra-bay vehicles 102, 104 and 106 that move through the bay along a path 108 and, in some cases, along the branch path 110. The system 100 also includes various stationary devices 116, 118, 120 and 122, each of which can perform some sort of operation on work-in-process carried by the vehicles 102, 104 or 106. The stationary devices 116, 118, 120 and 122 can also perform other functions unrelated to the work-in-process carried on the vehicles.

Vehicles traveling along path 108 enter the manufacturing bay 101 through door A and travel on the path 108. As they travel down the path 108, the vehicles come within the operational range of the stationary devices 116, 118 and 120 so that these devices can perform operations on the work-in-process carried by the vehicles. In the embodiment shown, a branch 110 of the path can be used to change the routing or path of the vehicles. For example, in certain circumstances, the vehicles can stay on path 108 and exit the manufacturing bay through door B. In other circumstances it may be necessary for one or more of the vehicles to exit the manufacturing bay through door C, in which case the vehicle is directed and rerouted onto branch 110 of the path.

In one embodiment, the path 108 and the branch 110 are tracks to which the vehicles are bound and along which they travel. In such an embodiment, a switch 112 can be used to control whether vehicles exit the bay using path 108 or path 110. In other embodiments, however, the path 108 need not be an actual physical element such as a track. For example, if the vehicles 102, 104 and 106 are robotic vehicles capable of being programmed, the path 108 and branch 110 may be routes pre-programmed into the vehicles.

In one embodiment, the stationary devices 116, 118, 120 and 122 can be robots that perform one or more operations on the work-in-process carried on the vehicles 102, 104 and 106; in the figure, an operation carried out by a device is depicted by an arrow extending between the device and the vehicle, for example the arrow extending between the device 116 and the vehicle 102. In one embodiment, the devices 116, 118, 120 and 122 can carry out operations on the work-in-process while it sits on the vehicle, but in other embodiments these devices can remove the work-in-process from the vehicle, perform their operations on the work-in-process, and then return the work-in-process to the same or another vehicle.

Figure 2:
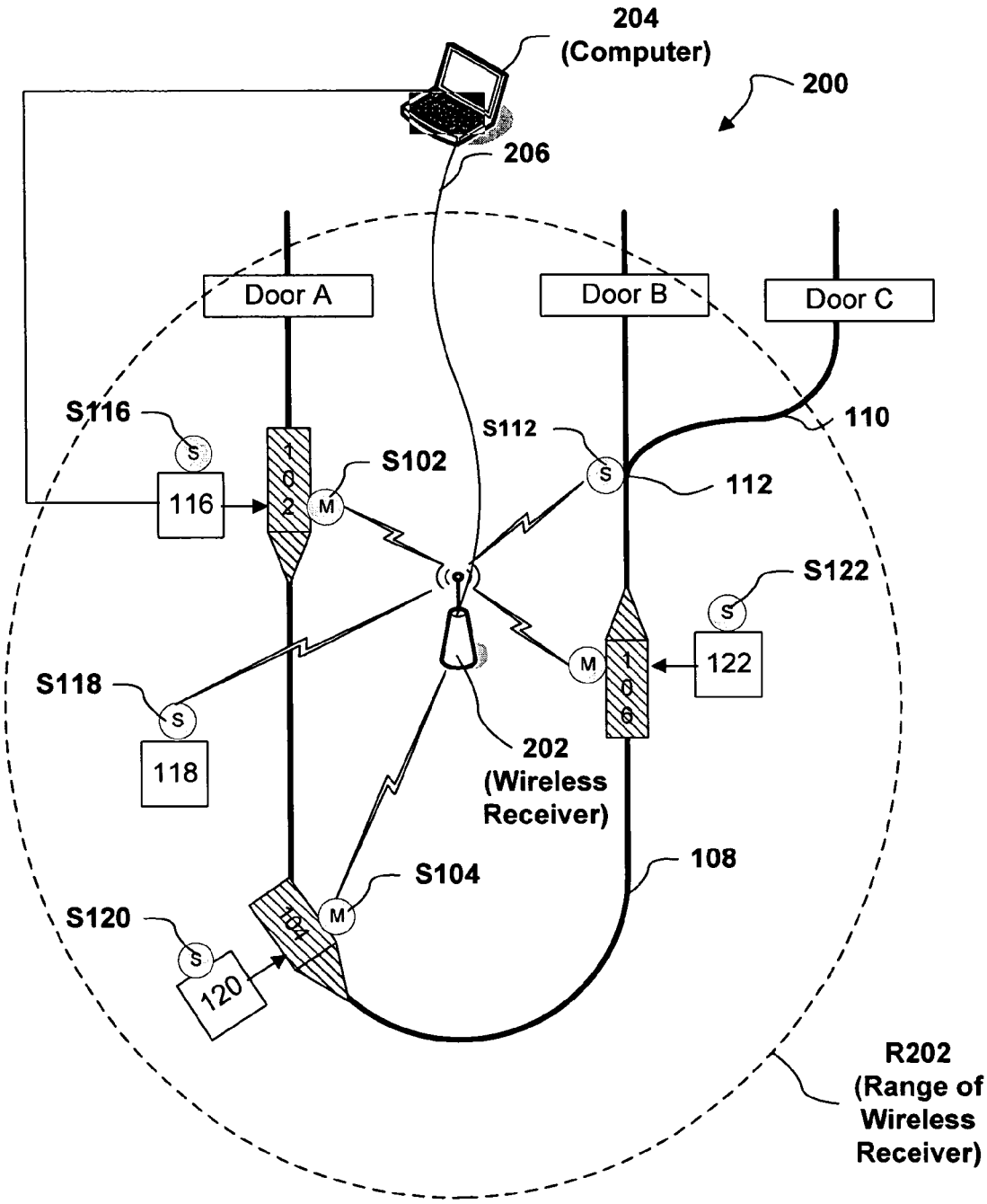
FIG. 2 is a plan-view schematic of an embodiment of the invention applied to the transport section of an automatic material handling system (AMHS).

FIG. 2 illustrates an embodiment of an automatic material handling system 200 including a sensing system according to the present invention. As in the system 100, the system 200 includes several inter- or intra-bay vehicles 102, 104 and 106 that move along a path 108 and, in some cases, along a branch 110 of the path. The system 100 also includes various stationary devices 116, 118, 120 and 122 that can perform operations on work-in-process carried on the vehicles 102, 104 or 106. Of course, in other embodiments the system 200 can include more, less or different types of vehicles and stationary devices.

To be able to monitor the motion parameters of the vehicles 102, 104 and 106—meaning, for example, their velocities, accelerations along multiple axes, and so forth—each vehicle could be fitted with a sensor package, shown in the figure by an "M" in a circle to indicate that these sensor packages are mobile because they are attached to vehicles that can move. Another option for sensor placement is within a carrier that is being moved by a vehicle. Thus, vehicle 102 has a sensor package S102, vehicle 104 has a sensor package S104, and vehicle 106 has a sensor package S106. Additionally, to monitor motion parameters of the stationary devices 116, 118, 120 and 122—meaning, for example, accelerations along several individual axes, etc—each stationary device is also fitted with a sensor package, shown in the figure by an "S" in a circle to indicate that these sensor packages are stationary because they are attached to stationary devices. Thus, device 116 has a sensor package S116, device 118 has a sensor package S118, and so forth. Although described as "stationary," the stationary devices may not, of course, be completely stationary; otherwise it would be useless to measure their motion parameters. All the stationary devices can include moving parts such as robotic arms that cause the stationary device to vibrate and whose motion and resulting vibrations need to be measured. Sensor packages can also be attached to other elements of the system. For example, in a system where paths 108 and 110 are rails and a switch 112 controls the exit path taken by a vehicle, it may be useful to attach a sensor package S112 to the switch so that its motion can be monitored to anticipate problems. Other potential locations for the sensor could be on immovable items such as the enclosure for a moving robot, or on other items such as on structures within a building.

In the system 200, each sensor package attached to a vehicle or a stationary device includes a motion sensor coupled to a wireless transceiver. The system 200 also includes a wireless receiver 202 with a range denoted by the circle labeled R202 positioned within the system 200 where it will be able to receive wireless signals from some or all of the sensor packages attached to the vehicles 102, 104 and 106 and to the stationary devices 116, 118, 120 and 122. The wireless receiver 202 is in turn coupled to a computer 204 that gathers data received at the wireless receiver 202 from one or more of the mobile sensor packages S102, S104 and S106 and from one or more of the stationary sensor packages S116, S118, S120 and S122. In one embodiment, the computer 204 can also be coupled to one or more of the control units of vehicles 102, 104 and 106 and stationary devices 116, 118, 120 and 122, thus forming a closed-loop control system to control the vehicles or devices being monitored. Also, although the computer 204 is shown as a laptop computer, in other embodiments it could be a desktop, a networked server, or some other computing device. Details of an embodiment of a sensor package are discussed below in connection with FIG. 3.

In operation of the system 200, the vehicles 102, 104 and 106 enter the manufacturing bay through door A. Once inside the bay, the vehicles either move along path 108 and exit the manufacturing bay through door B, or are diverted at 112 onto branch 110 such that they leave the manufacturing bay through door C. In the embodiment shown, the wireless receiver is positioned such that all the sensor packages S102, S104, S106, S116, S118, S120 and S122 fall within its range R202. Thus, as each sensor package senses the motion of the vehicle or device to which it is attached, it time-stamps each collected data point and uses its transceiver to transmit the motion data to the wireless receiver 202 in substantially real time. The time-stamped motion data received at wireless receiver 202 is then transmitted to a computer 204, where it can be collected, analyzed, displayed, printed, stored, archived and otherwise used to analyze the system 200 and its performance.

Figure 3:
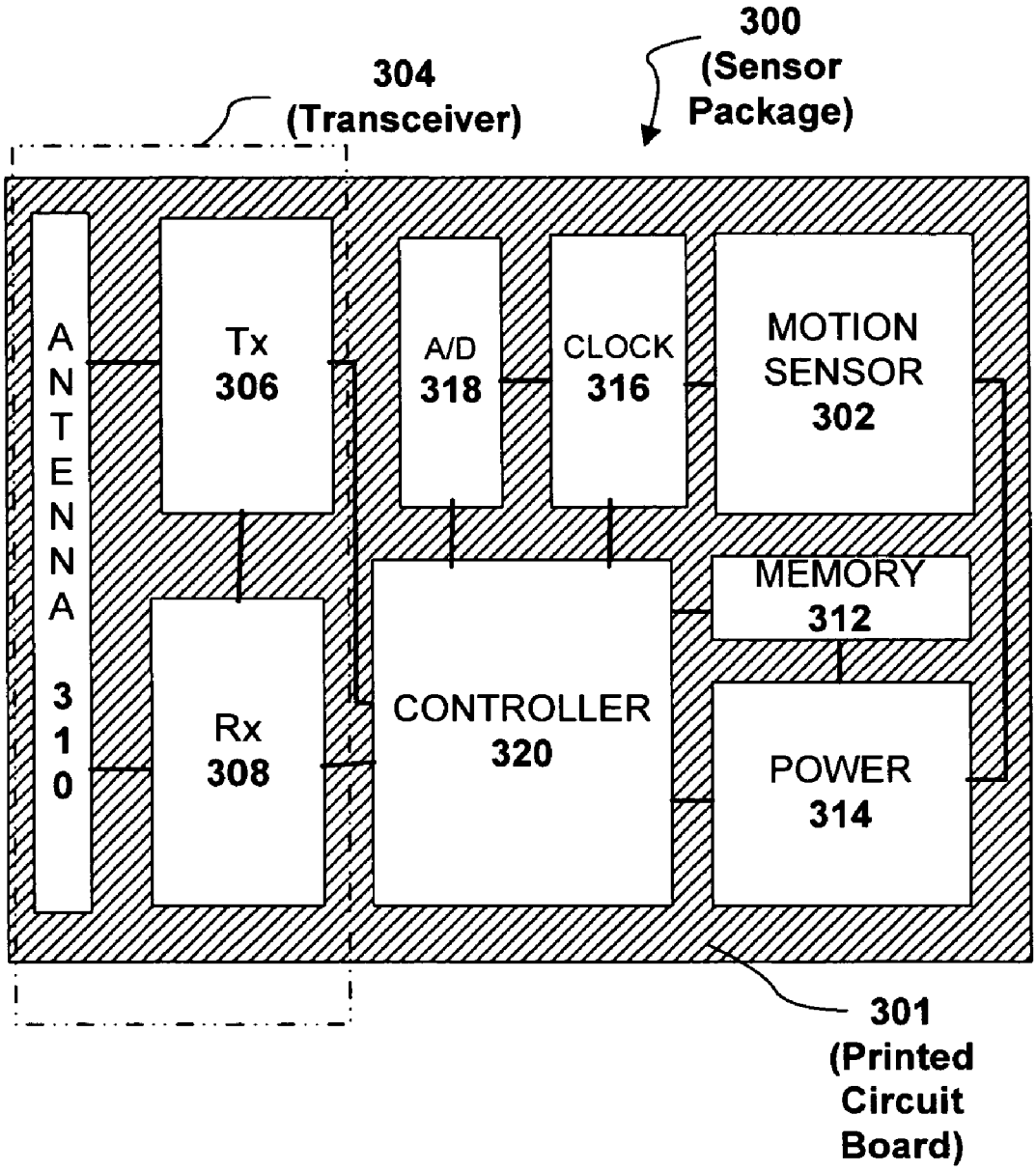
FIG. 3 is a plan-view schematic of an embodiment of a sensor unit usable in the embodiment of the invention shown in FIG. 2.

FIG. 3 illustrates an embodiment of a sensor package 300 that can be used in system 200 shown in FIG. 2. The sensor package 300 includes a printed circuit board 301 on which are mounted a motion sensor 302, a transceiver 304, a memory unit 312, a power source 314, a clock 316, an analog-to-digital (A/D) converter 318 and a controller 320; different embodiments of the sensor package 300 can, of course, include more, less or different components. In one embodiment, the sensor package 300 also includes its own software and operating system to direct the function of each individual component and the interaction between components, as well as to manage the communication between sensor package 300 and wireless receiver 202 or between sensor package 300 and another similar sensor package. In one embodiment the sensor package 300 is small (e.g., on the order of 1 inch by 1 inch) and very lightweight, so that it does not alter the mass of the vehicle or device whose motion it will monitor. In another embodiment, a composite sensor package can be constructed of multiple, stacked sensor packages such as the package 300.

The motion sensor 302 is generally chosen according to the motion parameters to be measured and the application in which the sensor package will be used. Sensors can be chosen that directly measure parameters of interest, or can be chosen to measure quantities from which parameters of interest can be derived. For example, an accelerometer can be used to measure accelerations along one or more axes. If velocities are needed, they can be obtained by integrating the acceleration data along the axis of interest. In some embodiments, the motion sensor 302 can itself include some processing capability useful for functions such as pre-processing data collected by the motion sensor 302.

In one embodiment, the motion sensor 302 can be a small, lightweight sensor that is easily mounted on the printed circuit board 301 and whose sensitivity is suitable for the application for which it will be used. For example, the motion sensor 302 can be a micro-electromechanical (MEMS) accelerometer that senses accelerations along one or more axes. In other embodiments, the motion sensor 302 need not be a single sensor, but can instead be a combination of different sensors. For example, if the application demands high sensitivity along one axis but not the others, a single-axis high-sensitivity accelerometer can be used along the high-sensitivity axis and can be combined with less-sensitive accelerometer to measure accelerations along the less-sensitive axes.

A clock 316 is mounted on the circuit board 301 and is coupled to the motion sensor 302, the analog-to-digital converter 318, the transmitter 306, the memory 312 and the power source 314. The clock 316 is incorporated into the sensor package 300 so that the data collected by the motion sensor 302 can be time-stamped. Time stamping allows the data collected by each sensor package to be correlated with other variables (e.g., position) so that a cause can easily be found for any problems identified by the data from the sensors. In one embodiment, the clock 316 on one sensor package can be synchronized with the clocks of other sensor packages or with some central clock using a synchronization signal. Also, although shown as a separate unit in this embodiment, in other embodiments the clock 316 can be incorporated into other units, such as the motion sensor 302.

The transceiver 304 includes a transmitter 306 and a receiver 308, both of which are coupled to an antenna 310 to enable them to transmit and receive signals, respectively. The transmitter 306 is coupled to the clock 316, as well as to the memory 312 and the power source 314. Similarly, the receiver is coupled to the memory 312 and the power source 314. In different embodiments the transmitter 306 and receiver 308 can communicate using any wireless MAN, WAN, LAN or PAN protocol including but limited to, for example, standard protocols such as IEEE 802.11 (WiFi), IEEE 802.16 (WiMax), UWB and Bluetooth.

The analog-to-digital (A/D) converter 318, as its name implies, converts analog data from the motion sensor 302 into digital data that can then be stored or transmitted. The A/D converter 318 is coupled to the clock 316, the transmitter 306, the memory 312 and the power source 314. The A/D converter 318 is shown in this embodiment as a separate unit, but in other embodiments it could be incorporated into another element of the sensor package 300.

The memory 312 can be any kind of volatile or non-volatile memory whose capacity is suitable for the application and whose power requirements are compatible with the power supply 314. In one embodiment, for example, the memory 312 can be a 32 MB flash memory, but in other embodiments it can be a different size or type of memory.

The power source 314 is sized so that it can provide the required power to all components of the sensor package 300 over a suitably long period of operation. In an embodiment in which sensor package 300 is completely stand-alone, for example, the power source 314 can be one or more commercially available batteries, such as N cells, AAA cells, watch batteries, and the like, mounted on the printed circuit board. Although shown in the figure as being built onto the printed circuit board, in other embodiments the power source 314 can be an external power source separate from the printed circuit board. For example, where the sensor package 300 is not required to be stand-alone, the sensor package may be connected to an external power source, for example one mounted on the vehicle or device to which the sensor package 300 is also mounted.

The sensor package 300 also include a controller 320 and associated software to control the sensor package and, optionally, to provide on-board computing capability for such things as pre-processing data collected by the motion sensor 302. The controller manages and controls each individual component of the sensor package, as well as the interaction between components and the communication between the sensor package 300 and the wireless receiver 202, other sensor packages, and so forth. In one embodiment, the controller 320 can be a general-purpose microprocessor programmed with an operating system to perform the necessary functions. In other embodiments, however, the controller can be a processor specially designed for the application, such as an application specific integrated circuit (ASIC). In the illustrated embodiment, several of the other components of the sensor package 300 are shown separate from the controller, but in other embodiments one or more of the other components could be integrated into the controller itself, or its functions implemented in software and performed by the controller.

In operation of the sensor package 300, the entire sensor package 300 is first mounted to a carrier or the vehicle or device whose motion parameters are to be measured. In one embodiment, the sensor package is rigidly mounted to the vehicle or device so that the motions will be properly transmitted to the motion sensor 302. Once the sensor package 300 is mounted, the motion sensor 302 senses the motion of the vehicle or device, and generates the data. The data is passed to the clock 316 and the A/D converter 318, where it is digitized and time-stamped. The time-stamped digital data can then be sent to the transmitter 306 for wireless transmission using antenna 310, or can be stored in memory 312 for later transmission or downloading. The sensor package 300 can also receive data through antenna 310 and receiver 308. The receiver 308 can then send the received data to transmitter 306 for immediate re-transmission or can store the received data in memory 312 for later transmission or downloading.

Figure 4A:
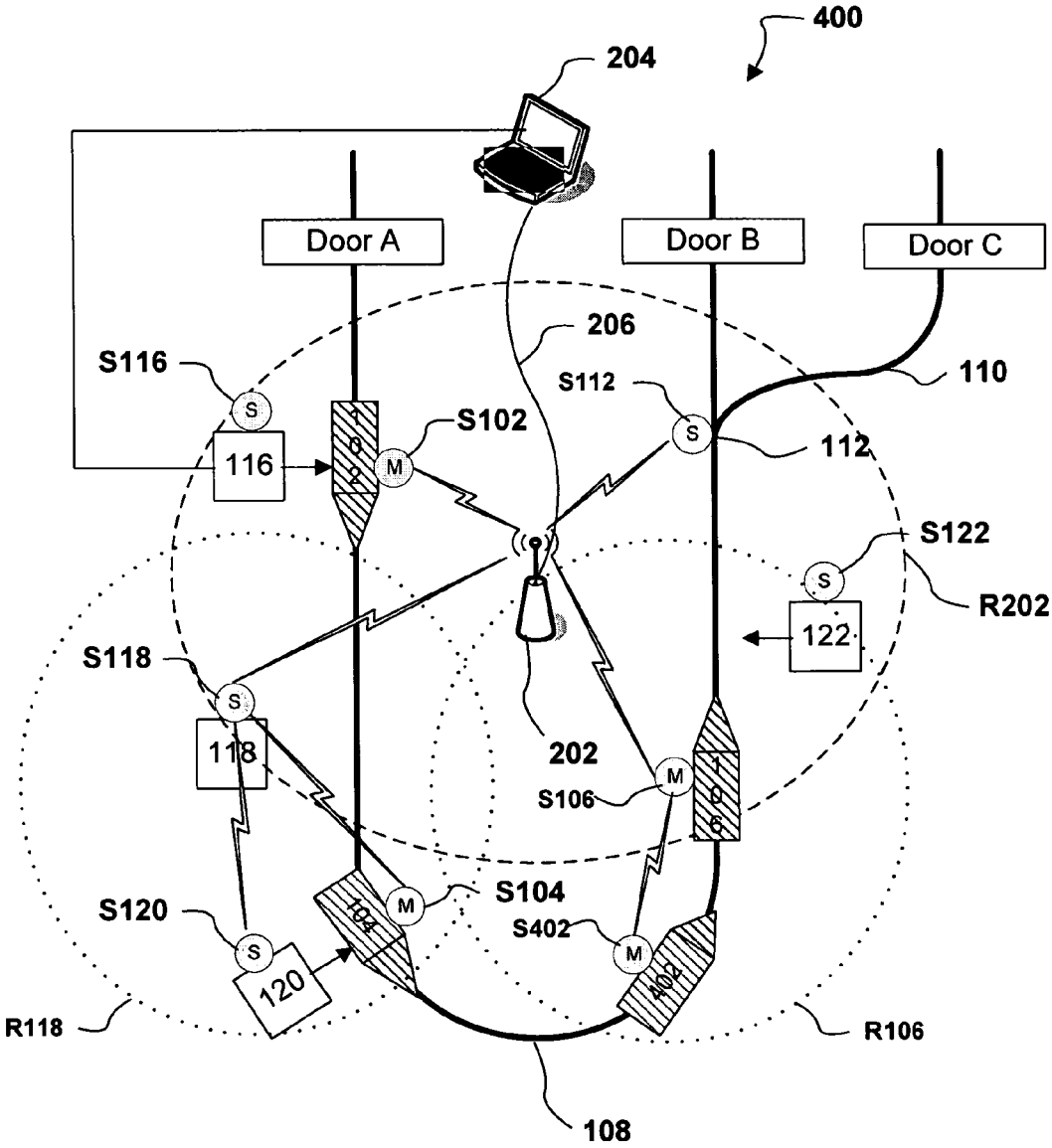
FIG. 4A is a plan-view schematic of an alternative embodiment of the operation of the embodiment shown in FIG. 2.
Figure 4B:
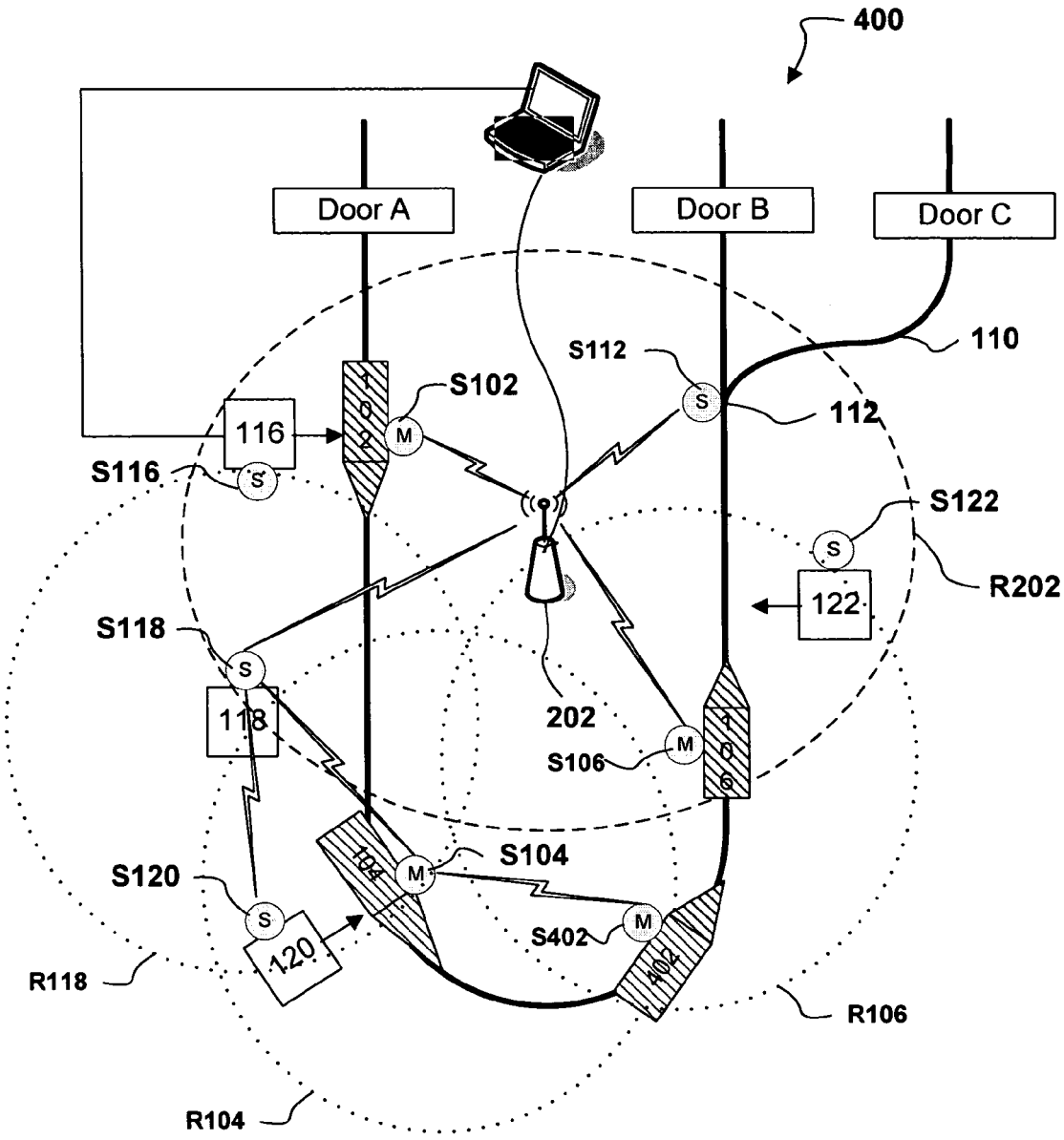
FIG. 4B is a plan-view schematic of another alternative embodiment of the operation of the embodiment shown in FIG. 2.
Figure 4C:
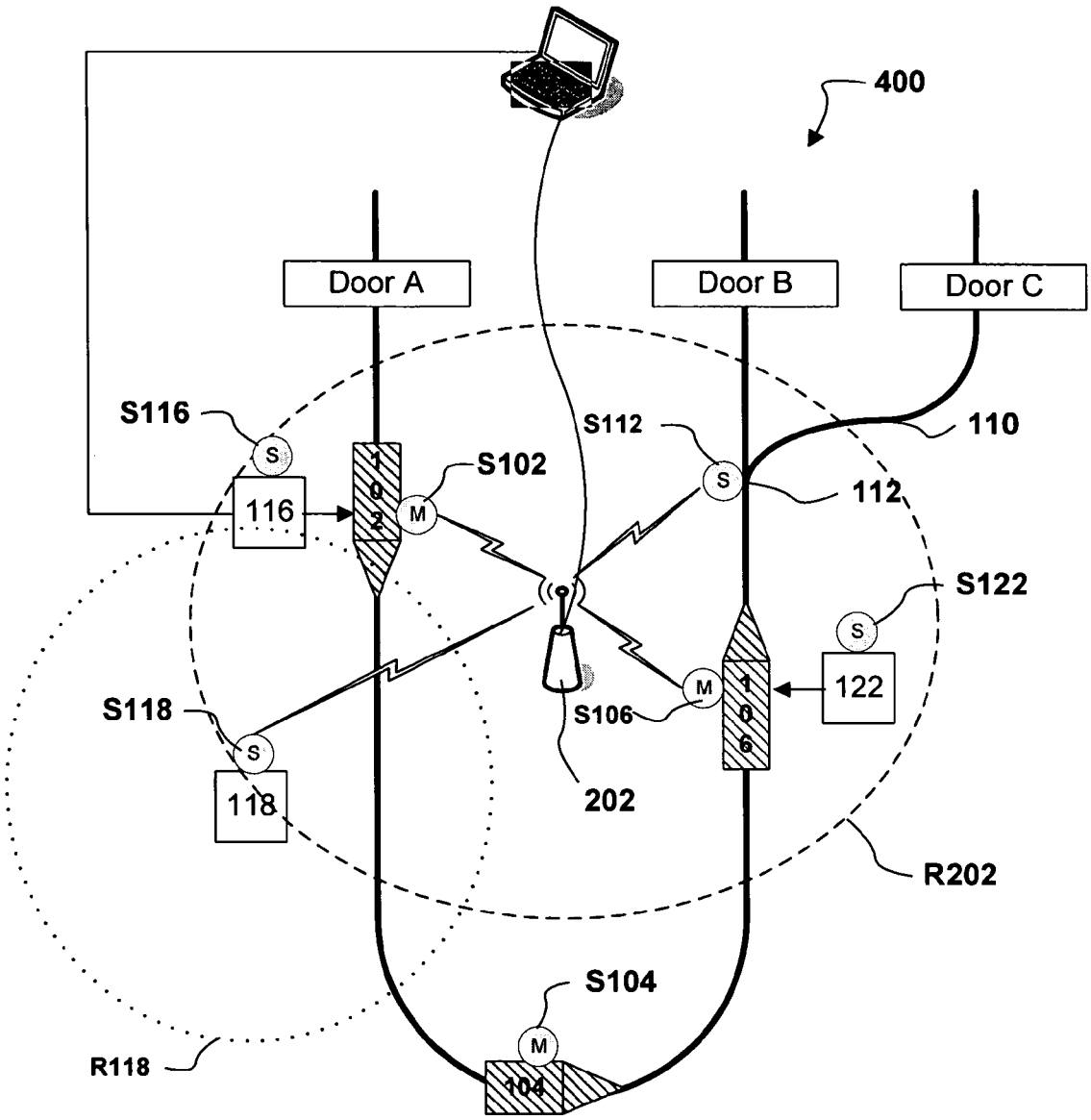
FIG. 4C is a plan-view schematic of yet another alternative embodiment of the operation of the embodiment shown in FIG. 2.

FIGS. 4A-4C, along with FIG. 2, illustrate the different modes of operation of the sensor package 300. Given the elements included in the sensor package 300, its operation within a system such as system 200 can have at least three different embodiments. The sensor package 300 can (i) sense motion parameter data with the motion sensor 302 and transmit the data through the transmitter 306; (ii) sense motion parameter data with the motion sensor 302 and store the data in the memory 312; or (iii) act as a router, receiving data from another sensor package via the receiver 308 and either immediately forwarding it via the transmitter 306 to either the wireless receiver 202 (see FIG. 2) or another sensor package or storing the received data until it can be forwarded. Note that combinations and variations of these three modes are also possible.

Which mode a particular sensor package operates in depends on its location relative to the wireless receiver 202 and relative to other sensor packages. When the sensor package is within range R202 of the wireless receiver 202 (see FIG. 2), the motion sensor 302 sends the data to the transmitter 306, which then transmits the data to the wireless receiver 202. If the sensor package 300 is not within range of the wireless receiver but is within range of another sensor package 300 that is within range of the wireless receiver 202, the transmitter 306 can transmit the data to the other sensor package 300, which can then route the data to the wireless receiver 202. Thus, each sensor package 300 can operate as a routing node for other sensor packages in addition to having its own sensing functions. A third mode of operation occurs when the sensor package 300 is outside the range of the wireless receiver 202 or of any other sensor package 300 that it can employ as a router. In such a case, data collected by the motion sensor 302 is stored in the memory 312 until the sensor package 300 can establish wireless contact with another sensor package or with the wireless receiver 202.

FIG. 4A illustrates an embodiment of the operation of a system 400 of the present invention. The system 400 is set up similarly to the system 200 shown in FIG. 2, except for the addition of vehicle 402 with its attached sensor package S402. In the system 400, the sensor packages S102, S106, S112, S116, S118 and S122 are within the range R202 of the wireless receiver 202. These sensor packages can therefore transmit data collected by their respective sensors directly to the wireless receiver 202 for transfer to the computer 204. Sensor packages S104, S120 and S402, however, are outside the range R202 and therefore cannot transmit directly to the wireless receiver 202.

Because sensor packages S104 S120 and S402 cannot transmit directly to the wireless receiver 202 an alternate path must be found for the sensor packages to get the data collected by their respective sensors to the wireless receiver 202. In the embodiment shown, an alternate path is created using some of the sensor packages as routers. Sensor packages S104 and S120 are outside the range R202 of the wireless receiver 202, but both are inside the range R118 of sensor package S118. Thus, both sensor packages S104 and S120 can use sensor package S118 as a router. Both S104 and S120 transmit their data to S118, which then forwards the data to the wireless receiver 202. Similarly, sensor package S402 is outside the range R202 of the wireless receiver 202, but is within the range R106 of the sensor package S106. Accordingly, sensor package S402 transmits its data to S106, which then forwards the data to the wireless receiver 202. Any combination of sensor packages can be used for routing: mobile-to-mobile, stationary-to-stationary, mobile-to-stationary and stationary-to-mobile. Variations on this theme are also possible in other embodiments. For example, if S402 was within range R106 but S106 was just outside range R202, S402 could still transmit its data to S106, which would then store the data in its memory until it came within R202, at which time it could retrieve the S402 data from its memory and forward it to the wireless receiver 202 or to another sensor package that comes within its range.

FIG. 4B illustrates an alternative embodiment of the operation of system 400 illustrated in FIG. 4A. The primary difference between this embodiment and the one shown in FIG. 4A is the use of multi-hop routing. Sensor package S402 falls outside the range R202 of the wireless receiver 202, but it falls within the range R106 of sensor package S106 and also falls within the range R104 of sensor package S104. Sensor S104 in turn is within the range R118 of sensor package S118. In this situation, sensor S402 can transmit data to S106, which can then forward it to the wireless receiver 202. Alternatively, if S106 cannot accept the data from S402—because of bandwidth limitations, for example—S402 can transmit to S104. Sensor package S104 then forwards the data to S118, which forwards it on to the wireless receiver 202. As before, any combination of stationary and moving sensor packages can be used in multi-hop routing.

FIG. 4C illustrates another alternative embodiment of the operation of system 400 illustrated in FIG. 4A. The primary difference between this embodiment and the one shown in FIG. 4A is the use of storage. As vehicle 104 travels along the path 108, it first passes out of the range R202 of the wireless receiver 202 and then out of the range R118 of sensor package 118. After traveling out of the range R118, the sensor package S104 is not within range of any other sensor package and has no way of sending its data to the wireless receiver 202. Faced with this inability to transmit its data, sensor package S104 stores data collected by the motion sensor in its memory until it reaches a location along path 108 or branch path 110 where it again comes within range of another sensor package that can route the data to wireless receiver 202. Thus, in situations where one or more of the sensor packages end up in positions where they are unable to transmit their data, the monitoring for those particular sensors ceases to be real-time and instead becomes near-real-time, at least temporarily. In another embodiment of the system 400 where real-time monitoring of motion parameters is not needed and off-line monitoring will do, any of the sensor packages can be set to store all data collected instead of transmitting it. After data is collected for a certain period of time, or until the memory is full, the data can be downloaded from the memory to the computer 204 to be processed, analyzed and so forth.

Figure 5:
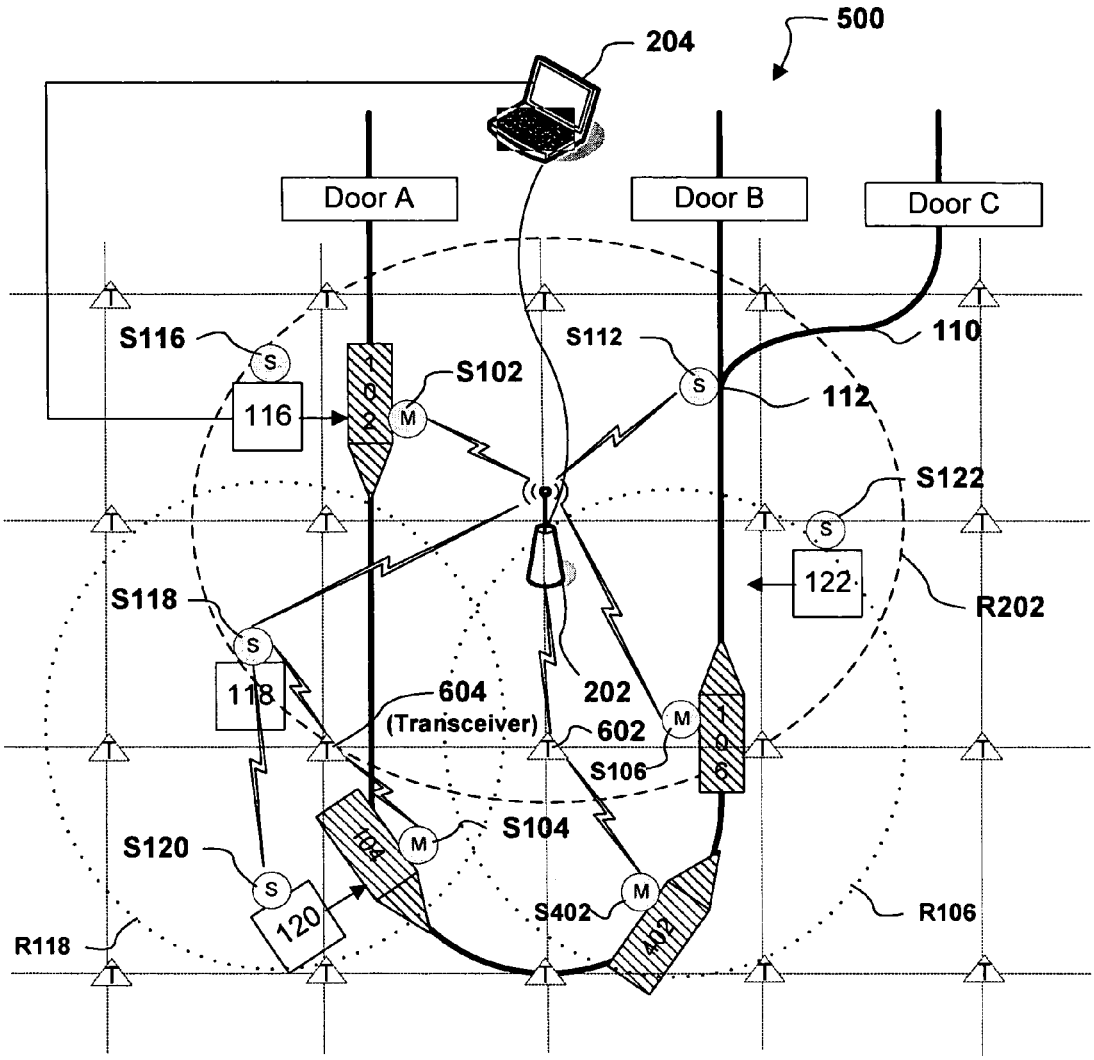
FIG. 5 is a plan-view schematic of yet another alternative embodiment of the operation of the embodiment shown in FIG. 2.

FIG. 5 illustrates an alternative embodiment of a sensing system 500 according to the present invention, as applied to an automated material handling system such as system 400. System 500 differs from system 400 primarily in the inclusion of one or more wireless transceivers (each designated in the figure by a T in a triangle) to the system. In one embodiment the transceivers can be used to add bandwidth to the system to boost its data-carrying capacity, while in other embodiments the transceiver can be used for redundancy in case the sensor units are unable to communicate with each other or with the wireless receiver 202.

Each transceiver, as its name implies, both transmits and receives data and therefore includes a transmitter and a receiver. Since the transceivers are wireless, they will also likely include an antenna coupled to both the transmitter and the receiver. Each transceiver can also include a memory where it can store received data until it can be forwarded. In addition, each transceiver could also a microprocessor/controller unit to manage all the activities within the transceiver. In one embodiment, the transceivers are similar in construction to the sensor packages shown in FIG. 3, except that they need not include the motion sensor 302 since they will be used as routers, not sensors.

In the embodiment shown, numerous transceivers are arranged in a regular grid, but other embodiments can include more or less transceivers. Other embodiments also need not have the transceivers positioned in a regular or irregular grid. Some embodiments, for example, may require only one or two strategically positioned transceivers.

In operation of the system 500, sensor package S402 is outside the range R202 of the wireless receiver 202 but within the range R106 of sensor package S106. If for any reason sensor package S402 cannot or does not want to transmit to S106, it can instead transmit to the transceiver 602. Transceiver 602 is within the range R202 of the wireless receiver 202, and can then forward the data received from S402 to the wireless receiver.

As in other embodiments, multi-hop routing can happen in this embodiment using any combination of transceivers, moving sensor packages and stationary sensor packages. For example if sensor package S104 is outside the range R202 of the wireless receiver 202, it can transmit data to transceiver 604, which can then forward the data to sensor package S118, which in turn forwards the data to the wireless receiver 202. The wireless receiver 202 then transfers the data to the computer 204. Although not shown, there could also be multiple routing hops between the transceivers, without any intervening sensor packages.

The above description of illustrated embodiments of the invention, including what is described in the abstract, is not intended to be exhaustive or to limit the invention to the precise forms disclosed. While specific embodiments of, and examples for, the invention are described herein for illustrative purposes, various equivalent modifications are possible within the scope of the invention, as those skilled in the relevant art will recognize. These modifications can be made to the invention in light of the above detailed description.

The terms used in the following claims should not be construed to limit the invention to the specific embodiments disclosed in the specification and the claims. Rather, the scope of the invention is to be determined entirely by the following claims, which are to be construed in accordance with established doctrines of claim interpretation.

The invention claimed is:

1. An automated material handling system in automated manufacturing that optimizes manufacturing throughput by orchestrating and optimizing various components of the system, comprising:

one or more wireless receivers;

one or more computers coupled to the one or more wireless receivers;

two or more sensor packages, each sensing motion parameters of various components of the system, comprising:

a micro-electromechanical (MEMS) motion sensor, an analog-to-digital converter coupled to the MEMS motion sensor, a wireless transceiver coupled to the MEMS motion sensor, wherein each sensor package communicates with one or more wireless receivers and, when in proximity, with one or more other sensor packages, a memory coupled to the MEMS sensor and to the wireless transceiver, wherein the memory stores received data until the sensor package comes within range of the wireless receiver or another sensor package, and a clock to time-stamp data generated by the MEMS motion sensor; and one or more wireless transceivers, wherein each of the one or more wireless transceivers can communicate with the one or more sensor packages, with the one or more wireless receivers, and with one or more other wireless transceivers.

2. The system of claim 1 wherein the one or more sensor packages include one or more sensor packages attached to moving vehicles.

3. The system of claim 1 wherein the one or more sensor packages include one or more sensor packages attached to stationary devices.

4. The system of claim 1 wherein the MEMS motion sensor is an accelerometer.

5. The system of claim 1 wherein each sensor package further comprises a controller to manage and control all the sensing and communication activities within the sensor package.

* * * * *